US010456693B2

(12) United States Patent
Priest et al.

(10) Patent No.: US 10,456,693 B2
(45) Date of Patent: Oct. 29, 2019

(54) RING SWING

(71) Applicant: M&M Sales Enterprises Inc., Dubuque, IA (US)

(72) Inventors: John Brian Priest, Dubuque, IA (US); Sarah E. Till, Peosta, IA (US); Ryan J. Fens, Dubuque, IA (US)

(73) Assignee: M&M Sales Enterprises, Dubuque, IA (US)

( * ) Notice: Subject to any disclaimer, the term of this patent is extended or adjusted under 35 U.S.C. 154(b) by 39 days.

(21) Appl. No.: 15/788,959

(22) Filed: Oct. 20, 2017

(65) Prior Publication Data

US 2019/0118100 A1 Apr. 25, 2019

(51) Int. Cl.
*A63G 9/00* (2006.01)
*A63B 7/00* (2006.01)

(52) U.S. Cl.
CPC ..... *A63G 9/00* (2013.01)

(58) Field of Classification Search
CPC ... A63G 9/00; A63G 9/02; A63G 9/04; A63G 9/10; A63G 9/12; A63G 31/00; A63G 31/007; A63B 7/00; A63B 9/00; A63B 2009/006; A63B 2208/12
USPC ..... 472/118–125, 61, 128; 482/23–24, 482/35–36, 44, 49
See application file for complete search history.

(56) References Cited

U.S. PATENT DOCUMENTS 3,918,709 A * 11/1975 Bishop ..... A63G 9/00 472/118
4,487,413 A * 12/1984 Fall ..... A63B 21/0023 482/23
4,799,667 A * 1/1989 Suchy ..... A63B 19/04 280/206
4,921,245 A * 5/1990 Roberts ..... A63B 7/02 482/23
4,961,574 A * 10/1990 Lew ..... A63B 69/0064 280/206
5,046,721 A * 9/1991 Altare ..... A63B 19/04 428/47
6,932,710 B1 * 8/2005 Hartin ..... A63B 7/00 472/118
7,727,078 B2 * 6/2010 Arnold, IV ..... A47C 7/725 446/227
8,591,348 B2 * 11/2013 Brown ..... A63G 9/00 472/118
8,784,227 B2 * 7/2014 Speedie ..... A47D 9/02 472/119
2005/0049055 A1 * 3/2005 Publicover ..... A63B 67/06 472/118
2006/0111194 A1 * 5/2006 Dillner ..... A47D 13/105 472/119
2011/0312430 A1 * 12/2011 O'Toole ..... A63G 9/00 472/118

* cited by examiner

*Primary Examiner* — Kien T Nguyen
(74) *Attorney, Agent, or Firm* — Rathe Lindenbaum LLP

(57) ABSTRACT

A swing may include a ring. In one implementation, the swing may include a first handle projecting from an inner side of the ring on a first side of the ring and a second handle projecting from the inner side of the ring on a second side of the ring. In another implementation, the ring may include a seat mounted to the ring and extending inwardly of the ring.

16 Claims, 3 Drawing Sheets

RING SWING

BACKGROUND

Swings are commonly found in parks, playgrounds and residences. Such swings come in a variety of forms. Some swings allow a person riding the swing to swing to and fro. Other swings allow a person riding the swing to spin or swing in a circle.

Figure 1:
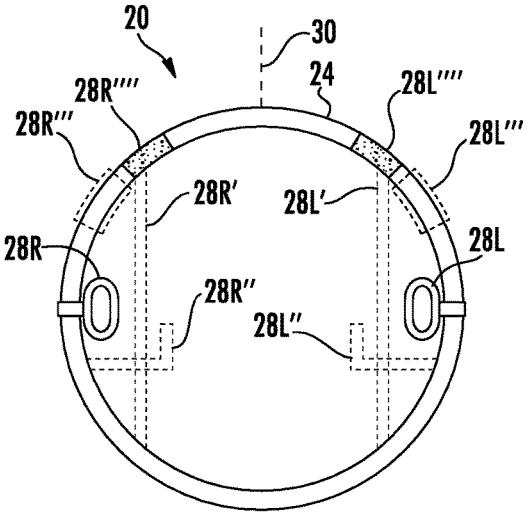
FIG. 1 is a front view of an example swing.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION OF EXAMPLES

Despite a long-standing use of swings and the numerous variety of swings in existence, most swings lack handles for a person to grip when riding the swing. For example, disk swings which include a circular disk suspended by a cable require the rider to grasp the cable. Swings having a plank or band supported by a pair of chains or cables require the rider to grasp the chains or cables. Swings formed from tires require the rider to either grasp the line suspending the tire or to wrap his or her arms about the tire.

Disclosed herein are swings that provide handles for a person to grip while using the swing. Disclosed herein is a swing that is in the form of a suspended ring, wherein handles are provided along the inner side of the ring. For purposes of this disclosure, the term "ring" refers to any continuous or endless structure, not limited to being circular and not limited to any particular shape. For example, a "ring" may have a circular, oval or polygonal shape. A ring may be formed from one integral unitary body or may be formed from multiple segments mounted are connected to one another to form the ring. A ring may have any of a variety of different cross-sectional shapes. For example, a ring may comprise a flat band or may have a circular, oval or polygon or cross-sectional shape. The ring may be solid or ring may be hollow.

In some implementations, the handles may be repositioned at any one of a plurality of different positions about the ring to accommodate different ergonomic parameters or user preferences. In some implementations, handles are slidable along the ring. In some implementations, the handles are completely separable from the ring, wherein the handles may be selectively mounted at one of a variety of different available locations along the ring.

In some implementations, handles provide textured surfaces, high friction rubber -like surfaces or compressible surfaces that further facilitate reliable slip free gripping. In some implementations, the handles forming closures that completely extend about or encircle the person's hands, such as a fingers or palm of a hand. Such handles provide a rider, especially a young child, with a greater degree of confidence when riding the swing.

Disclosed herein are swings that are formed from a tubular ring supporting a seat mounted to the tubular ring. The tubular shape of the ring reduces a weight of the swing, allowing the swing to be hung from smaller structures or trees and also along the swing to be more easily pushed or spun by a non-rider or along the swing to be more easily swung by the rider. At the same time, because the seat is mounted to the tubular ring, the side of the seat is not dictated by the dimensions of the ring. As a result, the dimensions (and weight) of the ring are not dictated by the seat and the seat may project forwardly and rearwardly of the ring to provide a larger and more comfortable seating surface. The seat may have an upper concave contour or radius of curvature different than that of the ring to provide more comfortable and secure seating. The seat may have sidewalls generally extending parallel to a centerline of the ring, the sidewalls providing more secure seating upon the seating surface. Because the seat is mounted to the ring, the seat may be formed from different materials than that of the ring, such as higher friction or cushioned providing materials, and may be exchanged as a user or users of the swing age or grow in size.

The ring of the swing has an interior that completely surrounds or extends about a person riding the swing. The ring of the swing may have various shapes. For example, the ring of swing may have a circular shape, and oval shape or a polygonal shape, such as a triangle, square, rectangle, hexagon, octagon or the like.

In some implementations, the ring of the swing may removably support various swing accessories. For example, in some implementations, the ring may be hollow, enclosing a string of lights, such as string of light emitting diodes, wherein the individual light emitting elements of the string emit light that passes through openings or transparent windows formed in the tube. In some implementations, the lights may be actuated by an electric switch which selectively connects the string of lights to a battery contained within the ring. In another implementation, lights may be actuated between and on and off state in response to motion of the swing as detected by motion sensor. In some implementations, the ring may removably support accessories such as flags or propellers that move in response to air turbulence during swinging. In some implementations, the support accessories may comprise noisemakers that produce noise in response to airflow produced during use of the swing. The ring further provides surfaces to facilitate customization. For example, exterior surfaces swing may be different customized with stickers, colors and the like.

FIG. 1 is a front view of an example swing 20. Swing 20 comprises ring 24 and handles 28R, 28L (collectively referred to as handles 28). Ring 24 comprise a continuous hoop, loop or other structure. Although ring 24 is illustrated as extending in a circle, in other implementations, ring 24 maybe noncircular in shape, such as having the shape of an oval or a polygon. In one implementation, ring 24 comprise a single integral unitary body with no breaks along its length. In yet another implementation, ring 24 is formed from multiple arcuate or other shaped segments releasably snapped, fastened or otherwise mounted to one another to form the ring 24. Ring 24, when segmented, facilitates shipping and storage of swing 20.

Handles 28 comprise structures projecting inwardly of ring 24 that provide a gripping surface for a person riding swing 24. In one implementation, handles 28 themselves form rings, endless enclosing structures, wherein the interior of the handle rings are sized to completely surround and extend about a person's hand, the palms and/or fingers. In the example illustrated, handles 28 form such surrounding enclosures independent of ring 24. In such implementations, such rings forming handles 28 may be supported from ring 24 by a rigid band or bar or may be supported from ring 24 by a flexible band, strap or cord. For example, in one implementation, the rings of handles 28 may hang or dangle until being pulled upon by a user. In other implementations, handles 28 may be U-shaped (similar to shown in FIG. 9), wherein handles 28 form a surrounding hand enclosure have one side provided by the inner side of ring 24.

In still other implementations, handles 28 may have other sizes, shapes and configurations. For example, in one implementation, handles 28 may comprise a pair of vertical bar handles 28R', 28L' extending across the interior of ring 24 or a pair of joystick like handles 28R", 28L" projecting from the interior sides of ring 24. In each of such implementations, the gripping surfaces of the various handles 28 may be covered with a layer of rubber-like material or may be covered by a layer of a closed cell foam or other compressible material. In some implementations, handles 28 may comprise tubular sleeve handles 28R'", 28L'" of rubber-like or compressible material, such as a closed cell foam. In some implementations, the tubular sleeves may be replaced with regions of a a high friction-rubber-like coating or texturing, either in extending completely about the tubular exterior of ring 24 is shown with respect to handle 28"" or at least upon the exterior surfaces of ring 24, as shown with respect to handle 28"", to provide enhanced gripping.

Handles 28 (handles 28R, 28L, handles 28R', 28L', handles 28R", 28L", handles 28R'", 28ZL'" or handles 28R"", 28L"") are located on the right and left sides of ring 24, on opposite sides of the flexible suspension line or lines 30 (where ring 24 is supported by a pair of spaced rings) from which ring 24 is suspended. In the example illustrated, handles 28R and 28L are located at the 9 o'clock and 3 o'clock positions, angularly spaced 180° apart from one another. As shown by the examples of the various other forms of handles 28, handles 28 may be provided at a variety of other locations relative to one another about ring 24.

In the example illustrated in 1, a rider rests directly upon ring 24. In some implementations, swing 30 may additionally comprise a seat. In one implementation, the seed may be provided by a textured or coated portion of ring 24 extending along the lower interior surface of ring 24. In one implementation, seat may comprise a foam tube wrapped about the lower portion of ring 24, opposite to suspension line 30. In yet another implementation, the seat may comprise a structure mounted to ring 24 as we described hereafter with respect to other implementations.

Figure 2:
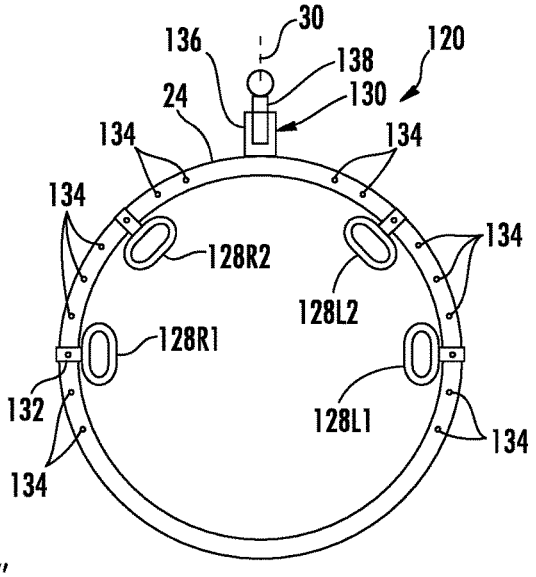
FIG. 2 is a front view of another example swing.

FIG. 2 is a front view of another example swing 120. Swing 120 is similar to swing 20 except that swing 120 comprises handles 128R1, 128L1, 128R2 and 128L2 (collectively referred to as handles 128) and further comprises spin bearing 130. Like swing 20, swing 120 may omit a seat or may include ace a seat as described above or described and illustrated below.

Handles 128R1, 128R2 and 128L1, 128L2 are similar to handles 28R and 28L, respectively, described above except that handles 128 are repositionable along ring 24 at any of a variety of different available locations. In one implementation, handles 128 are slidable along ring 24 and are retainable in a selected one of a plurality of available locations. For example, in one implementation, each of handles 128 may comprise an aperture 132 that is alignable with each of the various detents/apertures 134 spaced along ring 24, wherein a pin may be inserted through the aligned aperture/detent/aperture to releasably retain the particular handle 128 in place. In another implementation, each of each of apertures 134 may additionally include a resiliently biased pin that is resiliently biased outwardly into aperture 132, wherein depressant of the pen withdraws the pin from aperture 132, allowing the handle 128 to be slid to a new location. In yet other implementations, each of handles 128 may have a set screw which passed through handle 128 and which frictionally engages the sides of ring 24 to retain the particular handle 128 at a continuum of different locations along ring 24. In some implementations, handles 128 may have clamshell rings that wrap about 224, wherein the clamshell rings may be separated to allow handles 128 to be repositioned along ring 24.

In the example illustrated, handles 128R1 and 128L1 are illustrated as being located at the 9 o'clock and 3 o'clock positions while handles 128R2 and 128L2 are supported at the 10 o'clock and 2 o'clock positions. In other implementations, such handles 128 may be relocated at other locations as described above. In some implementations, handles 128R2, 128L2 may be omitted, where handles 128R1 and 128L1 may be selectively repositioned at any of the positions available, such as the positions available as indicated by detents 134.

Spin bearing 130 comprises a structure that facilitates bending of ring 24 about the axis of suspension line 30 without corresponding rotation or spending of suspension line 30. In one implementation, spin bearing 130 comprise a first portion 136 secured to ring 24 and a second portion 138 connected to suspension line 30, wherein portion 138 is captured within portion 136 while being rotatably supported within portion 136 by roller bearings, ball bearings or a low friction surface to facilitate rotation of portion 138 relative to portion 136. In other implementations, spin bearing 130 may be omitted.

Figure 3:
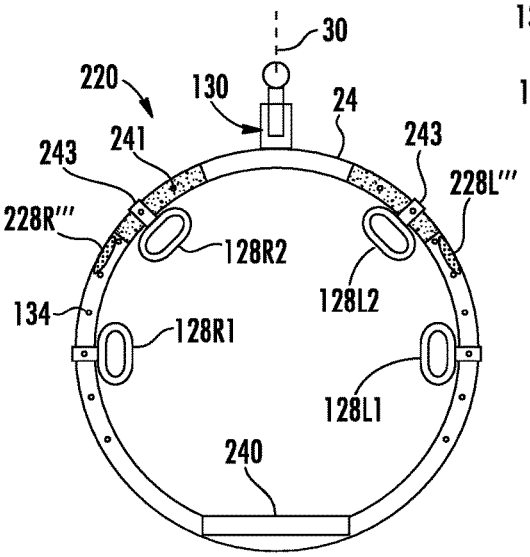
FIG. 3 is a front view of another example swing.

FIG. 3 is a front view of another example swing 220. Swing 220 is similar to swing 120 except that swing 220 is additionally illustrated as comprising handles 228R'", 228L'" (collectively referred to as handles 228) and is further comprising seat 240. In addition, an alternative mechanism for mounting handles 128R2 and 128L2 is illustrated. Those remaining components of swing 220 which correspond to components of swing 20 or 120 are numbered similarly.

Handles 228 comprise textured surfaces extending along the exterior of ring 24. In one implementation, the texturing may comprise grooves or serrations. In another implementation, the texturing may comprise dimples. In some implementations, the texturing may comprise a coating of a rubber -like material that is textured or that extends over a textured surface of ring 24, maintaining the outer textured profile. In the example illustrated, Such textured surfaces forming handles 228 do not substantially increase the dimensions of ring 24 such that handles 128 may slide over and across handles 228. In some implementations, the texturing may impede such sliding. In some implementations, as described above, handles 128 may completely separate from ring 24 and may be repositioned along ring 24 without sliding along ring 24.

Seat 240 comprise a structure extending along an interior ring 24 generally opposite to suspension line 30 and spin bearing 130 (when provided). In one implementation, seat 140 is integrally formed as a single unitary body with ring 24. In another implementation, seat 240 is mounted to ring 24, such that the 240 may have different dimensions and maybe form from different materials as compared to ring 24. For example, in one implementation, seat 240 may have a foam-like or compressible seating surface. In one implementation, seat 240 may have a textured or rubber-like (high friction seating surface).

In one implementation, seat 240 projects forwardly and/or rearwardly of the plane containing ring 24, forwardly of the front face of ring 24 and rearwardly of the rear face of ring 24. In one implementation, seat 240 is mounted to ring 24 by fasteners extending through seat 240 and into ring 24. In other implementations, the 240 may be mounted to ring 24 by clamps, U-bolts or the like.

As further shown by FIG. 3, in lieu of detents 134, a hook and loop fastener arrangement may be alternatively used to secure handles 128 releasably mount grip 430 at a selected one of different available positions. In the example illustrated, handles 128R2 and 128L2 are illustrated as being removably mounted and repositionable with respect to ring 24 using a hook and loop fastener arrangement. In the example illustrated, one of a hook and loop fastener may be provided as a band or patch 241 secured continuously along or at spaced locations along ring 24, wherein handles 128R2 and 128L2 each comprise a band or patch 243 of the other of the hook and loop fastener. For example, one implementation, each of such handles may include a strap having an inner surface with the other of the hook and loop fastener, wherein the strap wraps about the data the entire periphery of ring 24 which has a continuous outwardly facing ring of said one of the hook and loop fastener. With such a hook and loop fastener arrangement, handles 128 may be selectively positioned at a continuum of locations.

Figure 4:
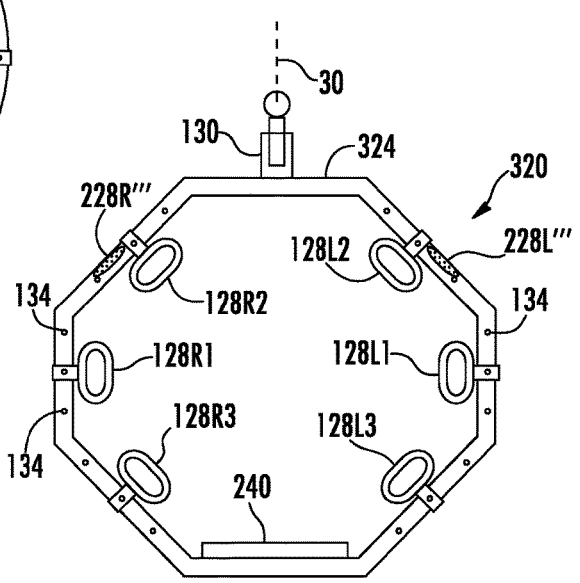
FIG. 4 is a front view of another example swing.

FIG. 4 is a front view of another example swing 320. Swing 320 is similar to swing 220 described above except that swing 220 comprises ring 324 in place of ring 24 and comprise an additional pair of handles 128R3, 128L3. Ring 324 is similar to ring 24 except that ring 324 is in the shape of a polygon, namely, an octagon. Handles 128R3, 128R3 project at angles in an upwards direction and provide handles for smaller children, closer to seat 240. Handles 128R3, 128L3 are structurally similar to handles 128R1, 128L1 described above, being repositionable along ring 324. In some implementations, such handles are further removable from ring 324. Those remaining components of swing 320 which correspond to components of swing 220 are numbered similarly.

Figure 5:
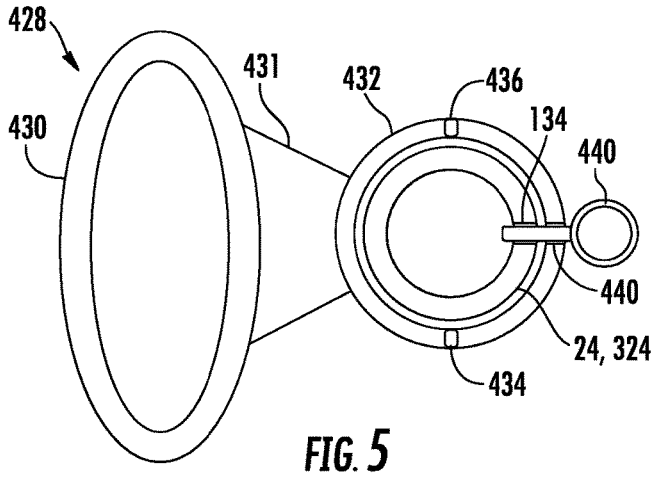
FIG. 5 is a front view of an example handle for a swing, with portions of the handle shown in section.

FIG. 5 illustrates handle 428, an example of handle 128 which may be utilized in swings 20, 120, 220, 320 described above and any of the swings described hereafter. For purposes of illustration, portions of handle 428 are shown in section. Handle 428 is illustrated as being repositionably mounted to ring 24, 324.

Handle 428 comprises grip 430, extension 431, collar 432, hinge 434, clasp 436 and location retainer 440. Grip 430 comprise a structure to be grasped by a person's hand. In the example illustrated, grip 430 comprises a ring in the shape of an oval. In other implementations, rib 430 may be ring having other shapes, such as circular or polygon of shapes. In yet other implementations, rib 430 may comprise a rod or bar, similar to that of a joystick and illustrated in FIG. 1 as handle 28R". In one implementation, grip 430 may be textured or may be covered with a coating are layer of rubber-like material or a compressible closed cell foam to further facilitate secure ripping of grip 430.

Extension 431 connects grip 430 to collar 432. In one implementation, extension 431 comprises a rigid member form from a metal or polymer. In other implementations, extension 431 may comprise a flexible member, such as a flexible elastomeric or rubber-like band or a rope. In some implementations, extension 431 may be sufficiently flexible so as to allow grip 431 to hang or dangle from collar 432. In such an implementation, handle 430 may hang out of the way when a rider is not using handle or when a rider is using a different one of handles on the swing.

Collar 432 extends about ring 24, 324. In one implementation, collar 432 is slidable along ring 24, 324. In another implementation, collar 432 is not slidable, mounted in place at a selected one of available locations along ring 24, 324. In the example illustrated, collar 432 is in the form of a clamshell, mounting about ring 24, 324.

Hinge 434 and clasp 436 (schematically illustrated) facilitate opening and closing of collar 432 and securing a collar 432 about ring 24, 324. Hinge 434 may comprise mechanical hinge or a "living hinge" formed from a flexible interconnecting material that flexes or bends to allow the segments of collar 432 to open and close with respect to ring 24, 24. Clasp 436 comprise a mechanism to releasably secure ends of the segments together. In other implementations, clasp 436 (schematically illustrated) may comprise a latch, hook, snap, hook and loop fastener or other connection mechanisms.

Retainer 440 comprise a mechanism to releasably secure collar 432 in place at a selected one of the available positions along ring 24, 324. In one implementation, retainer 440 comprises a pin which extends through an aperture 440 and into a selected detent 134. In other implementations, retainer 440 may comprise a pin which is resiliently biased by a spring towards the tent 134, wherein a person may pull the pin, against the biases spring, to withdraw the pin from detent 134, facilitating sliding of collar 432.

In other implementations, grip 430 and extension 431 may be secured at selected locations along ring 24, 134 in other fashions. For example, in other implementations, extension 431 may comprise a cable or cord which may be tied at selected mounting locations along ring 24, 134. For example, eyebolts may be provided along the ring to facilitate such tying or the cable or cord of extension 431 may be passed through openings in ring 24, 324. In still other implementations, VELCRO may be utilized to releasably mount grip 430 at a selected one of different available positions. For example, one of a hook and loop fastener may be provided as a band or patch secured continuously along or at spaced locations along ring 24, 324, wherein extension 431, in the form of a flexible strap, band or cord, or in the form of a rigid bar, is secured to a band or patch of the other of the hook and loop fastener.

Figure 6:
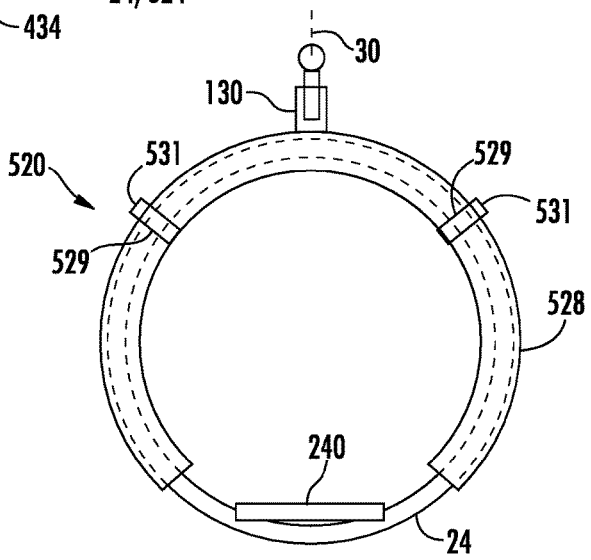
FIG. 6 is a front view of another example swing.

FIG. 6 is a front view of another example swing 520. Swing 520 is similar to swing 220 except that swing 520 comprises handles 528 in place of handles 128. Handles 528 are provided by a sleeve of rubber-like material or foam material encircling a wrapped about ring 24. In the example illustrated, handles 528 are provided by a single continuous sleeve of rubber-like or closed cell foam wrapped about ring 24. In one implementation, the sleeves are C-shaped and are secured to the exterior of ring 24 by an adhesive. In some implementations, sleeves are C-shaped and are releasably secured to the steering 24 by a hook and loop fastener arrangement, allowing the sleeve to be removed from ring 24.

In another implementation, the sleeves are C-shaped and are secured about the exterior ring 24 by at least one strap 529 wrapped about the sleeve and tightened by a buckle 531. In other implementations, handle 528 may be formed by multiple spaced sleeves of closed cell foam or rubber-like material, individually secured in place about ring 24 by such tightening straps or by hook and loop fastener arrangements as described above respect to the continuous sleeve. In such implementations, the individual sleeves may be removed from ring 24 or may be selectively repositioned at a plurality of different available locations using the tightening strap or multiple spaced hook and loop fastener components along ring 24.

Figure 7:
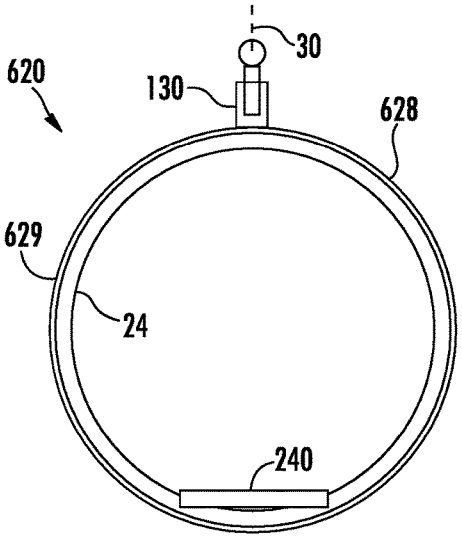
FIG. 7 is a front view of another example swing.

FIG. 7 is a front view of another example swing 620. Swing 620 is similar to swing 220 described above except that swing 620 comprises handles 628 in the form of a textured surface 629 along the outer surface of ring 24. The textured surface may be in the form of dimples or serrations along the outwardly facing surface of ring 24, though surfaces facing radially away from the centerline of ring 24. In the example illustrated, textured surface 629 is illustrated as continuously extending along the entirety of ring 24. In other implementations, textured surface 629 may be provided at spaced locations about ring 24.

Figure 8:
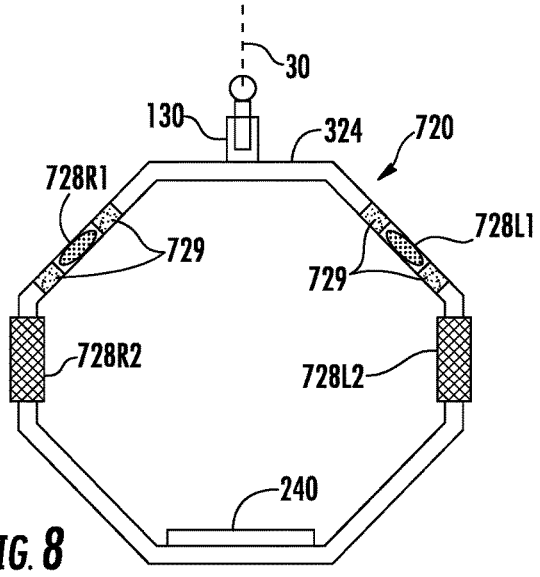
FIG. 8 is a front view of another example swing.

FIG. 8 is a front view of another example swing 720. Swing 720 is similar to swing 320 except that swing 720 comprises handles 728R1, 728L1 and handles 728R2, 728L2. Handles 728R1 and 728L1 are similar to handles 228 R'" and 228L'" described above except that handles 728R1 and 728R2 comprise textured surfaces that extend completely about ring 324.

Handles 728R2, 728L2 are similar to handles 528 described above with respect to FIG. 6 except that handles 728 comprise individual tubes or sleeves of a rubber-like material or a closed cell foam, the individual tubes or sleeves continues extending about ring 324. As described above, such tubes or sleeves may be permanently secured to ring 324 or may be removably secured to ring 324 by tightening straps, fasteners or hook and loop arrangements. In some implementations, other portions of ring 324 may include a hook and loop component 729, facilitating repositioning and mounting of handles 728R2, 728L2 in an alternative location.

Figure 9:
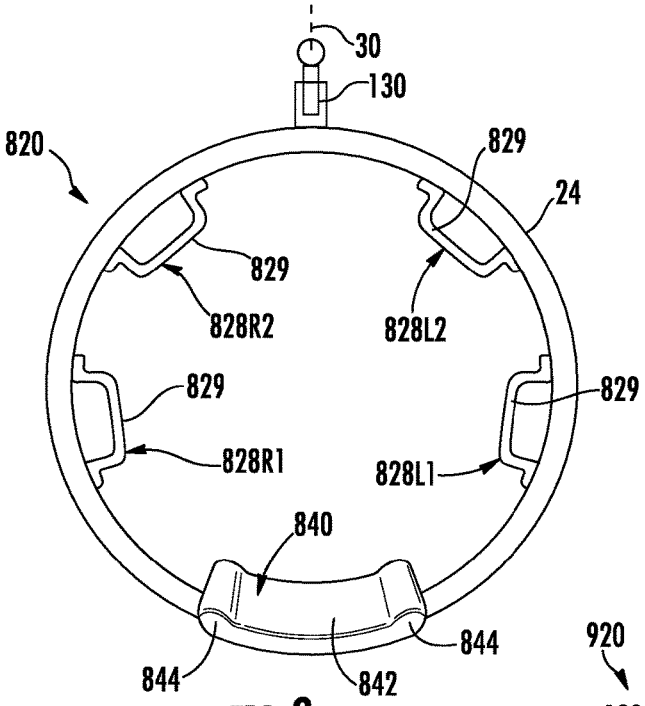
FIG. 9 is a front view of another example swing.

FIG. 9 is a front view of another example swing 820. Swing 820 is similar to swing 220 except the swing 820 comprises handles 828R1, 828L1, 828R2, 828L2 (collectively referred to as handles 828) and further comprises seat 840. Handles 828 are removably mounted to the interior of ring 24, extending inwardly toward the centerline of ring 24. Handles 828 are repositionable at a plurality of different locations through the use of circumferentially spaced detents or apertures 134 (shown and described above) which extend radially outward through ring 24. Handles 828 are each U-shaped, wherein handles 828 cooperate with the interior surfaces of ring 24 to form a hand enclosure that completely surrounds the user's hand (palm and/or fingers) when grasping the exterior textured bar portion 829 of each handle 828. In some implementations, such handles 828 may be removed and not used, orally a single set of handles is desired.

Seat 840 comprise a structure extending along an interior ring 24 generally opposite to suspension line 30 and spin bearing 130 (when provided). In the example illustrated, seat 840 is mounted to ring 24, such that seat 840 may have different dimensions and maybe form from different materials as compared to ring 24. For example, in one implementation, seat 840 may have a foam-like or compressible seating surface. In one implementation, seat 840 may have a textured or rubber-like (high friction seating surface).

In the example illustrated, seat 840 projects forwardly and/or rearwardly of the plane containing ring 24, forwardly of the front face of ring 24 and rearwardly of the rear face of ring 24. In one implementation, seat 840 is mounted to ring 24 by fasteners extending through seat 240 and into ring 24. In other implementations, seat 840 may be mounted to ring 24 by clamps, U-bolts or the like.

In the example illustrated, seat 840 comprises and upwardly facing concave surface 842 having a radius of curvature different than that of ring 24. Concave surface 842 is bordered on opposite sides by opposing end walls 844 that extend along respective axes that are generally parallel to the centerline of ring 24. End walls 844 cooperate with concave surface 842 to form troughs that comfortably and securely retains a rider in place.

Figure 10:
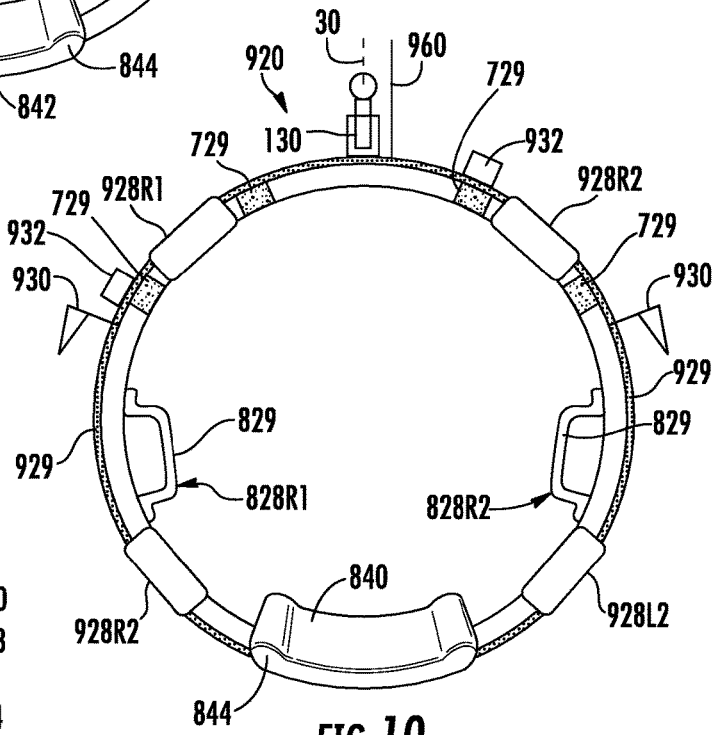
FIG. 10 is a front view of another example swing.
Figure 11:
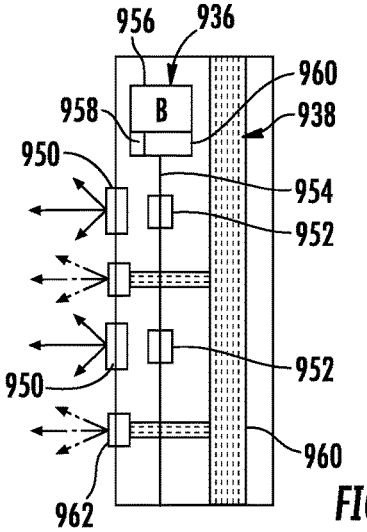
FIG. 11 is a sectional view of a portion of the swing of FIG. 10.

FIGS. 10 and 11 illustrate another example swing 920. Swing 920 is similar to swing 820 described above. Swing 920 additionally comprises handles 928R1, 928L1, 928R2 and 928L2 (collectively referred to as handles 928), handles 929, flags 930, sound generators 932 (schematically illustrated), illumination system 936 (shown in FIG. 11) and misting system 938 (shown in FIG. 11).

Handles 928 are similar to handles 728R2, 728L2 described above. Handles 928 comprise individual tubes or sleeves of a rubber-like material or a closed cell foam, the individual tubes or sleeves continues extending about ring 24. As described above with respect to handles 728, such tubes or sleeves may be permanently secured to ring 24 or may be removably secured to ring through four by tightening straps, fasteners or hook and loop arrangements. In some implementations, other portions of ring 24 may include a hook and loop component 729, facilitating repositioning and mounting of handles 928R1, 928L1 in alternative locations.

Handles 929 are similar to handles 629 described above, formed by textured outer surfaces of ring 24. In the example illustrated, the textured outer surfaces completely extend about the entire outer periphery of ring 24. In other implementations, such textured surface may be selectively applied or located at spaced locations about ring 24 to suggest locates at which ring 24 may be gripped.

Flags 930 comprise accessories movably mounted to ring 24. Flags 920 may fly or flap during use of swing 920. Sound emitters 932 comprise devices that channel or funnel airflow through a convoluted passage or across a reed or other vibrating member as swing 920 swings to and fro, creating a whistle (in the case of the convoluted passage) or a buzz (in the case of a reed) to create a sound from the airflow produced by the swing of swing 920.

Illumination system 936 (shown in FIG. 11) constitutes an accessory for swing 920 that provides a single color light or multiple lights. Illumination system 936 comprises light transmissive windows 950, light emitters 952, power line 954 and power source 956. Light transmissive windows 950 comprise openings or light transmissive panes formed in an outer wall of ring 24 that transmit light produced by light emitters 952.

Light emitters 952 comprise devices that produce or emit light upon being supplied with electrical current. In one implementation, light emitters 952 comprise light emitting diodes. In one implementation, light emitters 952 emit a single color of light. In other implementations, light emitters 952 emit multiple different colors of light. In one implementation, light emitters 952 may emit light at a selected frequency. In one implementation, illumination system 936 comprises a motion sensor 958 (schematically illustrated), such as an accelerometer, that detects motion or the rate at which swing 920 is moving, wherein a controller 960, in the form of an application-specific integrated circuit, controller adjusts the frequency or brightness of the light emitted by light emitters 952 based upon the sensed motion of swing 920. For example, in one implementation, light emitters 952 may emit a continuous light when swing 920 is swing (or spun) at a first speed and may emit flashes of light which increase in frequency as swing 920 is swung at a faster rate. In some implementations, controller 960, following instructions contained in a non-transitory computer readable medium, may output signals causing light emitters 9502 change color as a sensed speed of movement of swing 920 changes. In some implementations, light emission system 936 automatically goes into a sleep mode or shuts off in response to a sensed lack of motion for a predetermined period of time.

Power line 954 transmits electrical current from power source 956. In one implementation, power line 954 may comprise a flexible cable caring electrical lines or lines for each of emitters 952. Power source 956 comprises a source of electrical power, such as one or more removable batteries which may be inserted into the interior of ring 24 through an openable cover or door.

In one implementation, windows 950 and light emitters 952 extend continuously about ring 24 on the exterior of ring 24, facing outwardly. In another implementation, window 950 and light emitters 952 are continuously spaced about ring 24 on the interior of ring 24, facing inwardly. In yet another implementation, windows 950 and light emitters 952 extend continuously about ring 24, facing in a forward or rearward direction (the direction in which swing 920 is swung). In other implementations, such windows 950 and light emitters 952 may be selectively spaced about ring 924. In some implementations, swing 920 may omit illumination system 936.

Misting system 938 comprises a mister or sprayer provided as part of swing 920. Misting system 938 sprays or mist a rider with water as a person swings, especially beneficial in warm weather. Misting system 938 comprises liquid line 960 and nozzles 962.

Liquid line 960 comprises a passage or tube for supplying pressurized liquid (such as from a hose connected to an outdoor spicket). Liquid line 960 is flexible and may be coupled to and supported by suspension line 30 so as to remain out of the way as swing 920 is swung. Liquid line 960 supplies the pressurized liquid to each of the nozzles 962. Nozzles 962 are spaced about ring 24. In one implementation, nozzles 962 continuously extend about ring 24. In one implementation, nozzles 962 extend above sea 840, such as between handles 928R1 and 928L1. In one implementation, nozzles 962 face radially inward. In other implementations, nozzles 962 face forward or at forward or rearward angles. Nozzles 962 may be adjustable to provide varying degrees of spray. In one implementation, nozzles 962 are to spray the rider with a light mist of water. In one implementation, misting system 938 may be disconnected from the source of pressurized liquid so as to not be utilized. In some implementation, misting system 938 may be omitted.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. For example, the described seat 840 may be utilized in any of the described swings. The flags 930, noise generators 932, illumination system 936 and misting system 938 may be individually utilized on any of the described swings. Each of the described handles may be utilized on any of the described swings.

Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A swing comprising:

a ring;

a first handle projecting from an inner side of the ring on a first side of the ring;

a second handle projecting from the inner side of the ring on a second side of the ring, wherein the first handle and the second handle each forms a surrounded opening inwardly spaced from the ring for reception of portions of a user's hand and wherein the first handle and the second handle are each U-shaped with bottom flanges secured to the ring; and a seat, having an upper concave surface, mounted to the ring and extending along an interior of the ring.

2. The swing of claim 1, wherein the first handle and the second handle are releasably retainable in a selected one of a plurality of positions along the first side and the second side of the ring, respectively.

3. The swing of claim 1, wherein the seat has a radius of curvature different than a radius of curvature of the ring.

4. The swing of claim 1, wherein the seat comprises a seating surface recessed between opposing end walls extending parallel to a centerline of the ring.

5. The swing of claim 1, wherein the ring extends in a circle.

6. The swing of claim 1 comprising textured grip regions along an exterior of the ring on opposite sides of the ring, the textured grip regions having a surface selected from a group of surfaces consisting of: serrations, grooves and dimples.

7. The swing of claim 1 further comprising, at least one sleeve wrapping about the ring, the at least one sleeve comprising at least one of a foam sleeve and a rubber-like sleeve.

8. The swing of claim 7, wherein the sleeve is C-shaped.

9. The swing of claim 7, wherein the sleeve is coupled to the tube by at least one hook and loop fastener.

10. The swing of claim 7, wherein the at least one sleeve comprises a foam sleeve.

11. The swing of claim 1, wherein the first handle and the second handle each are fixed against rotation relative to the ring.

12. The swing of claim 1, wherein the first handle and the second handle extend from a lower half of the ring.

13. The swing of claim 1 further comprising a light emitter supported by the ring.

14. The swing of claim 13 further comprising a motion sensor carried by the swing, wherein the light emitter changes between states based upon motion of the swing as detected by the motion sensor.

15. The swing of claim 1 further comprising:

a liquid line carried by the ring; and nozzles to direct liquid from the liquid line.

16. A swing comprising:

a tubular ring;

a seat, having an upper concave surface, mounted to the ring and extending inwardly of the ring; and a first textured region on an exterior surface of the tubular ring on a first side of the ring;

a second textured region on the exterior surface of the tubular ring on a second side of the ring, wherein the first textured region and the second textured region each have a surface selected from a group of surfaces consisting of: serrations, grooves and dimples; a first handle projecting from an inner side of the ring on a first side of the tubular ring, wherein the first handle and the second handle each forms a surrounded opening inwardly spaced from the ring for reception of portions of a user's hand and wherein the first handle the second handle are each U-shaped with both flanges secured to the tubular ring.

* * * * *